US008490253B2

(12) United States Patent
Junker et al.

(10) Patent No.: US 8,490,253 B2
(45) Date of Patent: Jul. 23, 2013

(54) APPARATUS AND METHODS FOR SPREADING FIBER BUNDLES FOR THE CONTINUOUS PRODUCTION OF PREPREG

(75) Inventors: Shawn W. Junker, Rockwall, TX (US); Shaun Michael Poh, Huntington Beach, CA (US); Ping Yee, Monterey Park, CA (US); Scott Alfred Rogers, Placentia, CA (US); Thomas A. VanHorne, Greenville, TX (US)

(73) Assignee: Cytec Technology Corp., Wilmington, DE (US)

( * ) Notice: Subject to any disclaimer, the term of this patent is extended or adjusted under 35 U.S.C. 154(b) by 170 days.

(21) Appl. No.: 13/097,839

(22) Filed: Apr. 29, 2011
(Under 37 CFR 1.47)

(65) Prior Publication Data

US 2012/0102678 A1 May 3, 2012

Related U.S. Application Data

(60) Provisional application No. 61/333,461, filed on May 11, 2010.

(51) Int. Cl.
*D01H 13/00* (2006.01)

(52) U.S. Cl.
USPC ..... 19/66 R

(58) Field of Classification Search
USPC ..... 19/66 R, 66 T, 144; 28/282, 283
See application file for complete search history.

(56) References Cited

U.S. PATENT DOCUMENTS

| | | | | |
|---|---|---|---|---|
| 3,423,795 | A | 1/1969 | Watson | |
| 3,698,039 | A | 10/1972 | Kalwaites | |
| 3,728,076 | A * | 4/1973 | Fleissner | 8/149.1 |
| 4,495,017 | A | 1/1985 | Abe et al. | |
| 5,000,807 | A * | 3/1991 | Stuart | 156/166 |
| 5,042,122 | A | 8/1991 | Iyer et al. | |
| 5,060,351 | A | 10/1991 | Street | |
| 5,101,542 | A * | 4/1992 | Nakagawa et al. | 28/282 |
| 5,182,839 | A | 2/1993 | Stuart | |
| 6,253,431 | B1 | 7/2001 | Ames et al. | |
| 6,743,392 | B2 | 6/2004 | Tanaka et al. | |
| 6,836,939 | B2 * | 1/2005 | Guirman et al. | 28/283 |
| 7,003,856 | B2 * | 2/2006 | Hayashi et al. | 28/282 |
| 2003/0172506 | A1 * | 9/2003 | Guirman et al. | 28/282 |

OTHER PUBLICATIONS

ISR/Written Opinion for PCT/US2011/034477 mailed on Jun. 22, 2011.

* cited by examiner

*Primary Examiner* — Shaun R Hurley
(74) *Attorney, Agent, or Firm* — Thi D. Dang

(57) ABSTRACT

Apparatus for producing spread fiber bundles by strategic use of tension control throughout the device and use of higher differential speeds between driven rollers and line speed of the running fiber bundle are provided herein, along with methods for producing spread fibers, prepregs, and articles of manufacture therefrom.

16 Claims, 3 Drawing Sheets

APPARATUS AND METHODS FOR SPREADING FIBER BUNDLES FOR THE CONTINUOUS PRODUCTION OF PREPREG

CROSS-REFERENCE TO RELATED APPLICATIONS

This application claims benefit of priority from U.S. Provisional Application No. 61/333,461 filed May 11, 2010, the content of which is incorporated herein by reference in its entirety.

BACKGROUND OF THE INVENTION

1. Field of the Invention

The invention relates to uniformly spreading continuous multiple filament fiber bundles and unidirectionally arranging in parallel for the continuous production of prepregs having reduced gaps and improved fiber-resin distribution. More specifically, the invention relates to apparatus using tension control throughout the apparatus and higher differential speeds between the surface periphery of driven rollers and the line speed (or running speed) of the fiber bundle, and methods for using same to achieve prepreg material used for fabricating articles of fiber-reinforced plastics that has a uniform thickness and few defects in appearance.

2. Description of the Related Art

Prepregs, in which reinforcing fibers are impregnated with a matrix resin, are well known in the art and are broadly used in various industrial/high performance fields, such as for aircraft and automobile materials, medical materials, and formed materials for sports and leisure (e.g., fishing rods, golf club shafts, badminton rackets, tennis rackets, etc.).

Producing more uniform prepregs with less thickness irregularity is preferable and critical to overall product quality. In order to achieve this, it is necessary to open (i.e., spread) the reinforcing fiber bundle before impregnating it with a matrix resin when forming a prepreg, for reducing the thickness of the reinforcing fiber bundle and for letting the matrix resin sufficiently fill the clearances between the single fibers of the reinforcing fiber bundle.

Accordingly, the technique for efficiently and properly opening or spreading the raw reinforcing fiber bundles is critical for producing a prepreg having uniform thickness, reduced gaps between fibers, and proper fiber-resin distribution. Various apparatus and methods for spreading fiber bundles and/or making pre-pregs are known in the art and include, for example, those described in U.S. Pat. Nos. 4,495,017; 5,042,122; 5,182,839; and 6,743,392.

Additionally, it is generally known that tension is the prime mover for spreading fiber bundles containing multiple filaments. Thus, higher tension typically creates wider spread of the fibers in the bundle. However, too high a tension makes impregnation difficult due to decreased permeability of the fiber in relation to the resin, roping of the fibers, and damaging the fibers (thereby causing fuzz) or breaking the fiber. Increased tension also increases forces and torques throughout the apparatus which leads to increased process costs.

Accordingly, the apparatus and methods for spreading multiply adjacent fiber bundles having multiple filaments for the continuous production of prepreg require further improvement. Apparatus and methods that uniformly spread continuous multiple filament fiber bundles and unidirectionally arrange the spread fibers in parallel for the continuous production of prepregs having reduced gaps and improved fiber-resin distribution would be a useful advance in the art and could find rapid acceptance in the industry.

SUMMARY OF THE INVENTION

It has now been discovered that continuous multiple filament fiber bundles can be uniformly spread at lower tensions thereby increasing permeability to resins, decreasing gaps from roping, and decreasing fuzz due to damage thereby providing a superior prepreg product and ultimately a superior article of manufacture made therefrom. Such improvements are achieved by strategic use of tension control throughout the spreading apparatus. This advance drives the tension of the fiber bundles very high and then drops it down low such that by using moderate tensions throughout the entire apparatus the fiber spread is increased without the use of extremely high tensions that were otherwise thought necessary to achieve such objectives. Additionally, use of higher differential speeds between the driven roller bars and the running fiber bundle has also been shown to improve fiber spreading mechanics.

Accordingly, in one aspect the invention provides an apparatus for producing a spread fiber bundle having a tension control module that includes a tension building unit configured as a series of static bars and a tension reducing unit configured as a series of driven rollers, wherein the static bars and driven rollers are configured perpendicular to the direction of a running fiber bundle that makes direct wrapping contact with the surface of the series of static bars and driven rollers, and wherein the peripheral surface speed of the driven rollers is operated at least three times the line speed of the running fiber bundle.

In another aspect, the invention provides methods for producing a spread fiber bundle using an apparatus as described herein by running a fiber bundle in direct wrapping contact with the surface of a series of static bars and/or driven rollers, and controlling tension of the fiber through the apparatus by operating the driven rollers at a higher differential speed in relation to the speed of the running fiber bundle, thereby spreading the fiber bundle.

The invention as described in detail herein also relates to the production of prepreg. Accordingly, in another aspect the invention provides methods for the continuous production of rolled prepreg unidirectionally arranged and having uniform distribution between fibers by integrating an apparatus as described herein as part of a composite processing machine, running a plurality of adjacent fiber bundles in direct wrapping contact with the surface of a series of static bars and/or driven rollers, spreading the plurality of adjacent fiber bundles by operating the driven rollers at a higher differential speed in relation to the speed of the running fiber bundle, and impregnating the spread fiber bundles with a pre-determined amount of resin.

In other aspects, the invention provides methods for producing a prepreg by impregnating a pre-determined amount of resin into a spread fiber bundle produced according to the methods described in detail herein.

In another aspect, the invention provides prepreg materials produced according to the methods described in detail herein, as well as articles of manufacture made from the prepregs made according to those methods.

In another aspect, the invention provides a composite processing system having two or more fiber spreading devices according to the invention described herein in detail, wherein each spreader device is situated in a different path and receives a different set of a plurality of adjacent fiber bundles.

These and other objects, features and advantages of this invention will become apparent from the following detailed description of the various aspects of the invention taken in conjunction with the accompanying Figures and Examples.

DETAILED DESCRIPTION OF CERTAIN EMBODIMENTS OF THE INVENTION

Figure 1:
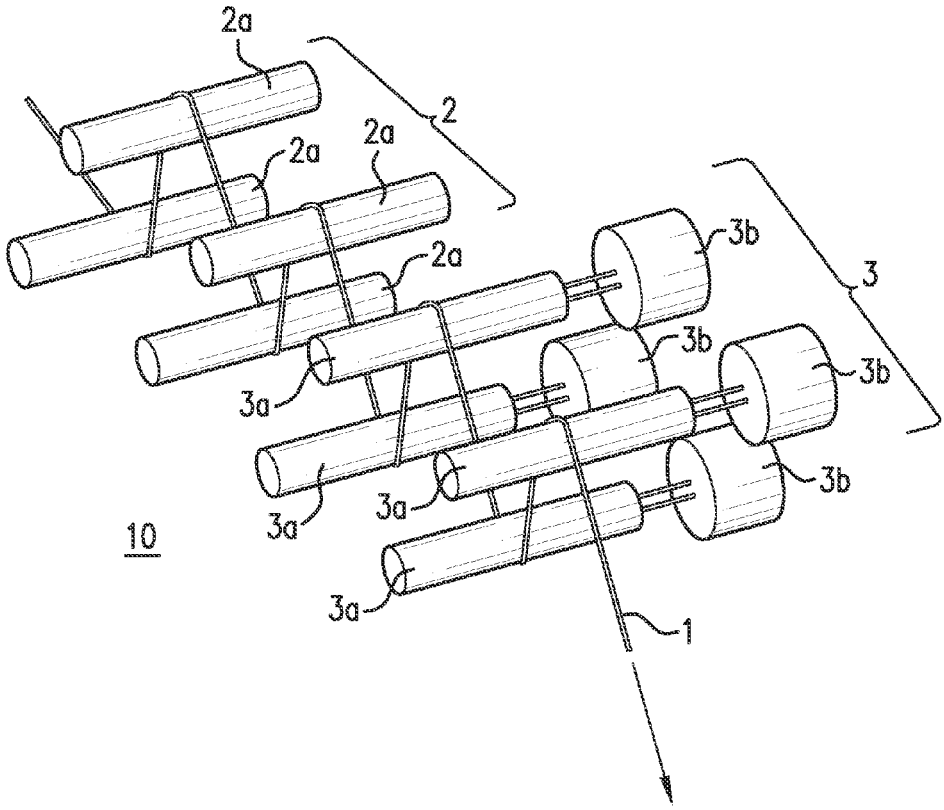
FIG. 1 provides a profile view of an apparatus according to one embodiment of the invention, wherein a single fiber bundle having multiple filaments is seen making direct wrapping contact with the surface of a series of static bars and driven rollers to provide an optimally tensioned and uniformly distributed spread fiber.

The present invention provides an apparatus for producing a spread fiber bundle by strategic use of tension control throughout the spreading device and use of higher differential speeds as between the driven rollers and the line speed of the fiber bundle, along with methods for producing spread fibers and prepregs and articles of manufacture therefrom. As summarized above, it has been discovered that the fiber spreading mechanics known in the art can be greatly improved by strategic use of tension control throughout the spreading apparatus and the use of higher differential speeds between roller bar surface and line speed of the fiber. Tension is the main factor in spreading multiple filament fiber bundles, but it is also the main factor (e.g., too high a tension) in roping, reducing permeability to resin impregnation, and defects such as fluff (also called fuzz balls), pilling gaps, fiber disorder, etc. The increase, maintaining, and then reducing tension through the spreading cycle provides the necessary means to combat roping and other undesirable fiber properties, but also to maximize spreading, thereby opening the fiber bundle and controlling (i.e., increasing or decreasing) the permeability to resin impregnation. As the ratio of the surface speed of the roller bar to the linear speed/running speed of the fiber bundle increases beyond 2 times, significant gains in spreading are seen. The gains decay with a logarithmic behavior however. Improvements to the mechanics of fiber spreading ultimately lead to improvements in prepreg products and articles manufactured therefrom, as uniformity of thickness and occurrence of gaps, along with fiber-resin distribution, are critical to overall product quality.

Apparatus

Accordingly, in one aspect the invention provides an apparatus for producing a spread fiber bundle having a tension control module that includes a tension building unit configured as a series of static bars and a tension reducing unit configured as a series of driven rollers, wherein the static bars and driven rollers are configured perpendicular to the direction of a running fiber bundle that makes direct wrapping contact with the surface of the series of static bars and driven rollers, and wherein the driven rollers of the tension reducing unit are operated such that their peripheral surface speed is at least three times the line speed of the running fiber bundle.

The fiber bundles used in apparatus according to the present invention are those composed of a large number of single filaments (e.g., 6K/bundle, 12K/bundle, or more) and preferably they are yarns or tows composed of bundles of continuous long filaments. For example, the fiber bundles can include, but are not limited to, organic fibers such as fibers of polyamide, polyester, polyacrylonitrile, polyvinyl alcohol, etc.; organic heat-resistant fibers such as fibers of aromatic polyamide (for example, Kevler® (Dupont, U.S.), polyfluorocarbon, phenol resin (Kynol®; Carbonrandam, U.S.), polyamide-imide, polyimide, etc.; rayon and natural fibers; inorganic fibers such as fibers of glass, boron nitride, carbon (including carbonaceous, graphitized, and flame-resisting fibers), silicon nitride, silicon carbide, alumina, zirconia, asbestos, etc.; metal fibers such as fibers of copper, tungsten alloy, iron, aluminum, stainless steel, etc., composite fibers such as fibers of boron with a core of tungsten, boron carbide with a core of tungsten, silicon carbide with a core of tungsten, boron, etc. and all others having a form of fiber. It is also possible to use fiber bundles composed of a combination of two or more of the above-mentioned fibers. The fiber bundles can have a sizing agent or oil deposited thereon for ease of handling and to prevent damage to the fibers. Typical and appropriate sizing agents are known to those of ordinary skill in the art and can include, for example, those described in U.S. Pat. No. 4,495,017. In one embodiment, the running fiber bundle is chosen from carbon, glass, polyamide, polyamide-imide, polyimide, aramid, and combinations thereof.

The fiber bundle includes a plurality of filaments that are arranged as a paralleled reinforcing fiber that can be wound on a spool. The spools of fiber can be placed on a tension creel such that the plurality of reinforcing fiber bundles can be arranged by a comb or rake at regularly spaced intervals as it is presented to the apparatus. As used herein the term "running fiber bundle" has its ordinary meaning known to those of ordinary skill in the art and refers to fibers that are being pulled from a spool on a tension creel, for example, by a pull-drum or take-up roll, through the apparatus. In certain embodiments, the running fiber bundle can include multiple adjacent bundles. In other embodiments, two or more sets of multiple adjacent fiber bundles can be provided in separate paths to be spread by a corresponding number of fiber spreader devices according to the invention.

Increasing tension of the fiber bundle before the drive rolls maximizes fiber spreading without requiring undue increase in tension. In the present invention, tension is initially increased through the use of the tension builder unit. In certain embodiments, the tension builder includes a member chosen from a tension creel; one or more driven roller operating at a slower speed than the linear speed of the running fiber bundle (i.e., a slow speed roll); one or more static bar (i.e., a fixed type bar that does not rotate); and combinations thereof. In some embodiments, the tension builder unit can be provided for by a series of slow speed driven rollers and static bars. In other embodiments, the tension builder unit can be provided for by one or more static bars.

In certain embodiments, the apparatus can include a tension mediating section located downstream from the tension building section and having a series of static bars and one or more driven roller operating at a faster speed than the linear speed of the running fiber bundle (i.e., a fast or high speed roller). This section can serve to adjust the tension of the fiber bundle downward on the driven rollers while building the tension of the fiber bundle back up as the fiber comes in direct wrapping contact with the surface of the static bars, thereby further opening/spreading the fiber bundle with every repeated cycle. In some embodiments, the tension mediating section can have high speed driven rollers and static bars in alternating positions. In other embodiments, the high speed driven rollers can sandwich one or more of the static bars. The static bars and driven rollers of the fiber spreading apparatus can be arranged in either a horizontal or vertical alignment so long as the running fiber bundle is in direct wrapping contact with the surface of driven rollers and the static bars.

The apparatus according to the invention also includes a tension reducing section/unit having a series of high speed driven rollers that help reduce tension in the running fiber bundle. As used herein the term "series" has its ordinary meaning known to those of skill in the art and refers to two or more of the object of which it modifies.

The running speed of the fiber bundle (i.e., transfer speed) can range from 2 m/min. to 20 m/min., with a preference of 2 to 10 m/min. In some embodiments, the peripheral surface speed of the high speed driven rollers ranges from 3 to 100 times the speed of the running fiber bundle. For example, in certain embodiments the peripheral surface speed of the high speed rollers can range from 3 to 50 times the speed of the running fiber bundle; 3 to 25 times the speed of the running fiber bundle; or 3 to 10 times the speed of the running fiber bundle.

The static bars and driven rollers (or spreader bodies as they are sometimes called), having at least a part of the curved surface of a column or cylinder, are solid or hollow columns or cylinders, and also a part of a curved surface cut off from a column or cylinder of a large diameter may be used. The material is not particularly specified, but it is preferable to select one which has a small frictional coefficient, is not extremely deformed or abraded by the friction with the fiber bundles, and does not oxidize with sharp crystalline structures. Usually, stainless steel is used, but a static bar or driven roller made of a metal covered with a synthetic resin such as teflon, etc., iron, copper, etc. and inorganic substances such as glass, alumina, etc. can be used. The diameter, number, type of combination and spatial arrangement are selected considering the balance between the spread width and the damage of the fiber bundles, and therefore they cannot be determined definitely, but for fiber bundles having a high modulus of elasticity, spreader bodies with a large diameter are used, and it is desirable that the number, type of combination and spatial arrangement of the spreader bodies should be selected taking account of the contact length between the fiber bundles and the curved surfaces, and the pressing force against the spreader bodies caused by the tension. The type of spreader bodies (whether they are of fixed type (i.e., static), or whether they are of driving type, which gives a differential peripheral speed in the travelling direction of the fiber bundles, exerts a great influence on the spreading effects (the spread width and damage of the fiber bundles). Therefore, in carrying out the process of the present invention, it is desirable, taking the above-mentioned effects into consideration to use the various types of rollers singly or in combination of two or more types. Furthermore, the tension and speed of the fiber bundles should be, of course, uniform in order that any disorder of the fiber bundles does not occur, and they are selected in relation with the spreading effects.

The use of a surface finish on both the static bars and driven rollers can also be included on the apparatus according to the present invention, thereby further reducing the tension required to open the fiber bundle and achieve a particular fiber width. The static bars and driven rollers can be made from stainless steel, for example, and sanded in the axial direction with sandpaper of various grit. For example, in some embodiments the static bars and driven rollers bars can have a surface finish imparted by sanding with 180 grit to 400 grit sandpaper, and preferably with 180 grit to 220 grit. In still other embodiments, some spreader bodies can be surface finished with one grit size while other spreader bodies are surface finished with a different grit size. Similarly, the spreader bodies can also have different surface finishes. In some embodiments, for example, the spreader bodies may be both dimpled and sanded, or some dimpled and some sanded. In other embodiments, the spreader bodies can be surface finished by whatever means known to those of ordinary skill in the art which reduces the co-efficient of friction of the fiber on the spreader bodies and simultaneously spreads the fiber bundle at lower tensions.

Additionally, it may be desirable to arrange the position of the unidirectional fiber bundles, which are in parallel and adjacent with one another, by making the fiber bundles pass through a comb-like structure called a rake. In some embodiments, such a rake can be positioned downstream from the creel and upstream from the tension building unit such that the fiber bundles are positioned within a width corresponding to the final width of the prepreg sheet. In other embodiments, another rake can be positioned between the tension building unit and the tension reducing unit. If there is more than one set of multiple adjacent fiber bundles in separate paths, there can be a rake in each path for each set of multiple adjacent fiber bundles to pass through. In such a case, the rakes for each set of multiple adjacent fiber bundles can be slightly off-set so that the spread bundles from each set are arranged in such a way as to reduce the incidence of gaps and promote uniform fiber-resin distribution.

An apparatus according to the present invention can also include a heating source positioned to heat the reinforcing fiber bundle. The heating source can be provided by any means including, but not limited to, conduction, convection, or radiation means. Heating the reinforcing fiber bundle can be advantageous in order to soften the sizing agent or oil that may be deposited thereon, and to generally enhance efficiency of the spreading action by reducing the co-efficient of friction between the fiber and spreader bodies (i.e., static bars and driven rollers). In some embodiments, the heating source can be provided as an indirect heating source such as by blown gas or by radiant heat. In other embodiments, the static bars and/or driven rollers themselves can be heated such that the contact surface of the roller bar becomes heated. It is preferable that the running fiber bundle is exposed to a heating temperature range from 50° to 250° C. (depending on the fiber sizing used), with 70° to 180° C. being most common.

In some embodiments, the fiber spreading apparatus of the present invention can be a singular component. In certain embodiments, the apparatus can be a component of a composite processing machine such as, for example, a prepreg processing machine. In such an assembly, the apparatus according to the invention can be located downstream from a tension creel containing spools of fiber bundles and upstream from an impregnation system. In certain embodiments, two or more fiber spreading devices can be integrated into a prepreg processing machine, such as where there are two or more sets of multiple adjacent fiber bundles running in separate paths. In other embodiments, the fiber spreading apparatus according to the invention can be a component of a weaver loom and can be located downstream from a tension creel and upstream from a composite processing machine.

Certain embodiments of the invention will be described below in reference to the drawings.

FIG. 1 shows a perspective view of an apparatus according to the invention as described above. In FIG. 1, a fiber spreading device 10 is depicted and includes a tension building section 2 and tension reducing section 3, wherein a single running fiber bundle 1 supplied by a spool of fiber as on a tension creel (not shown) travels in the direction of the arrow and enters the tension building section 2 in direct wrapping contact with the surface of a series of static bars 2*a* en route to the tension reducing section 3, which contains a series of high speed driven rollers 3*a* with which the fiber bundle maintains its direct wrapping contact. The high speed driven rollers are independently rotated by a drive motor 3*b* or other means known to those of skill in the art. As depicted, the fiber spreading device 10 drives the tension of the running fiber bundle 1 very high via a series of static bars 2*a* in the tension building unit 2 and then drops the tension of the fiber bundle down low via a series of high speed driven rollers 3*a* in the tension reducing unit 3, thereby spreading/opening the fiber bundle more with each alternation of a high speed driven roller and without the use of extremely high tensions. Immediately downstream of the fiber spreading device 10 and ready to receive the now open fiber bundle is a composite processing machine or impregnation system (not shown) known to those of ordinary skill in the art. Though the fiber spreading device 10 is only depicted with a single running fiber bundle 1 those of ordinary skill in the art will immediately understand and appreciate that there can be multiple fiber bundles unidirectionally arranged (i.e., in parallel with each other), and that there can be additional fiber spreading devices for embodiments where there are a corresponding number of sets of multiple adjacent fiber bundles in separate paths.

Figure 2:
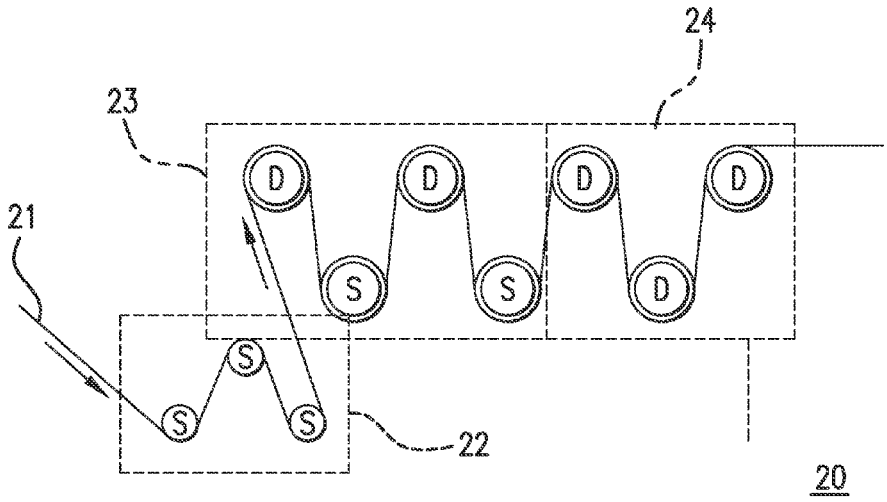
FIG. 2 is a perspective view of an apparatus according to another embodiment of the invention that provides a tension mediating unit as part of the apparatus.

FIG. 2 shows a profile view of an apparatus according to another embodiment of the invention as described above. In FIG. 2, a fiber spreading device 20 is depicted and includes a tension building section 22, a tension moderating section 23, and a tension reducing section 3, wherein a single running fiber bundle 21 supplied by a spool/bobbin of fiber as on a tension creel (not shown) travels in the direction of the arrow and enters the tension building section 22 in direct wrapping contact with the surface of a series of static bars S en route to the tension moderating section 23, where the running fiber bundle is placed in direct wrapping contact with the surface of an alternating series of low and/or high speed driven rollers D and static bars S, and then continues running through the tension reducing unit 24, where the running fiber bundle is placed in direct wrapping contact with the surface of a series of high speed driven rollers D. As depicted, the fiber spreading device 20 drives the tension of the running fiber bundle 21 very high via placing it in direct wrapping contact with a series of static bars S in the tension building unit 22 and then alternates the tension low and high by placing the running fiber bundle in direct wrapping contact with a series of low and/or high speed rollers D and static bars S in the tension moderating unit 23, and finally drops the tension of the fiber down low by placing the fiber bundle in direct wrapping contact with a series of high speed rollers in the tension reducing unit 24, thereby spreading/opening the fiber bundle more with each wrapping contact with a drive bar and without the use of extremely high tensions. As in FIG. 1, immediately downstream of the fiber spreading device 20 a composite processing machine or impregnation system (not shown) known to those of ordinary skill in the art can be placed ready to receive the now open fiber bundle. Alternatively, the fiber can be taken up on a drum/pull roll.

Methods

In another aspect, the invention provides methods for producing a spread fiber bundle by running a fiber bundle through an apparatus as described in detail herein, and operating the driven rollers of the apparatus at a differential speed in relation to the speed of the running fiber bundle, thereby controlling the tension of the fiber throughout the apparatus and spreading/opening the fiber bundle.

In a method of producing the spread fiber bundle, various fibers can be used in producing a spread fiber bundle as described above. These fibers can also have various tensile strengths and elasticities depending on the fiber used. The final spread width of the fiber can be up to 4 times the original width of the fiber bundle and more typically will be up to 3.5 times the original width. Typically bobbins or spools having fiber bundle wound around them and installed on a tension creel will serve as the supply of running fiber. The tension can be changed on the creel as desired for stabilizing the spread state of the fiber bundle. In one embodiment at least one static bar and/or driven roller will be heated. In another embodiment, the running fiber bundle per se will be heated, such as by a radiant heater. In certain embodiments for methods of producing a spread fiber bundle, a rake can be positioned between the tension creel and fiber spreading apparatus so that any multiple adjacent fibers are uniformly spaced.

In another aspect, the invention provides methods for the continuous production of rolled prepreg unidirectionally arranged and having uniform distribution between fibers. In certain embodiments, the method can be achieved by integrating a fiber spreading apparatus as described herein in detail as part of a composite processing machine well known to those of skill in the art, running a set of a plurality of adjacent fiber bundles so as to make direct wrapping contact with a series of static bars and/or driven rollers, thereby spreading the fiber bundles, and impregnating the spread fiber bundles with a pre-determined amount of resin to form a prepreg sheet. For example, one set of a plurality of adjacent fiber bundles can include 2 or more fiber bundles, and typically between 5 and 20 fiber bundles. A second set can include an equal number of fiber bundles to the first set.

Figure 3:
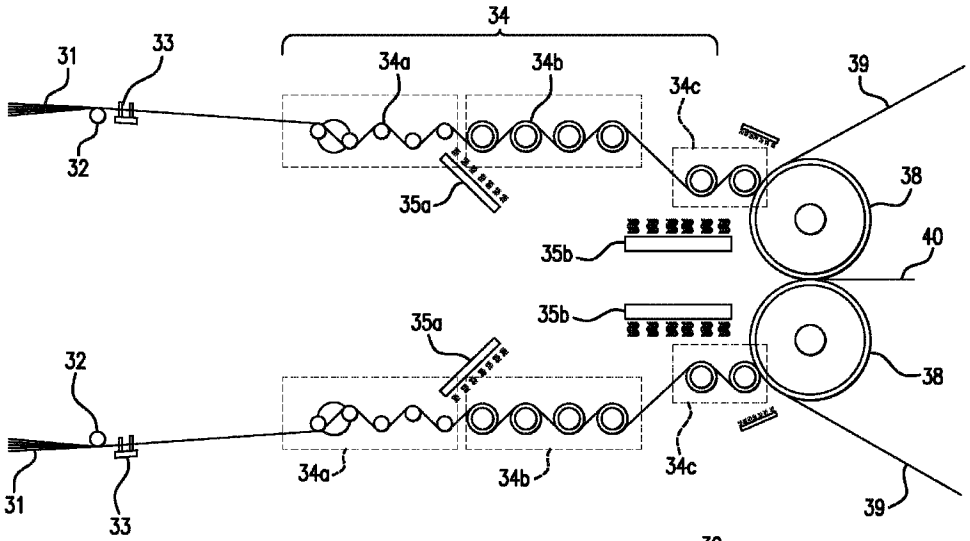
FIG. 3 is a perspective view of another embodiment of the apparatus according to the invention that is provided as a component of a composite processing machine. Such equipment can be used in performing the methods for continuous production of rolled prepreg according to the invention. In the particular embodiment depicted, two fiber spreading devices according to the invention are located in separate paths and are available to each receive a set of multiply adjacent fiber bundles wound on multiple spools which are positioned on one or more tension creel (not shown). The fiber spreading devices are located downstream from the tension creel and upstream from a composite processing system, such as a prepreg processing machine having an impregnation means.

In certain embodiments, the prepreg can be produced from two or more sets of a plurality of adjacent fiber bundles moving in separate paths (i.e., a 2-pattern or 2-path spread). In such embodiments, a corresponding number of fiber spreading devices according to the invention can be integrated into a composite processing system. FIG. 3 and Example 1 describe and exemplify such an embodiment, but other multiple path embodiments are also contemplated by the invention.

In a method for producing the rolled prepreg, the resin used and the resin impregnation method are not especially limited as numerous resins and methods/apparatus for impregnation are known to those skilled in the art. Examples of the resins that can be used include, but are not limited to, thermosetting resins such as epoxy resins (e.g., bisphenol A epoxy resin, phenol novolak epoxy resin, cresol novolak epoxy resin, glycidylamine epoxy resin, alicyclic epoxy resin, urethane modified epoxy resin, and brominated bisphenol A epoxy resin), vinyl ester resins, unsaturated polyester resins and phenol resins, thermoplastic resins such as polyester resins, polyethylene resins, polycarbonate resins, polyether resins, and polyamide resins, etc.

Although one resin can be used, two or more resins can be used together. Additionally, a liquid resin or a solid resin can be used and deposited on the fibers by, for example, immersing in solution or by slurry tank. A curing agent may be added to the resin system being used. For impregnation, a resin lowered in viscosity by heating or dissolving in a solvent can be impregnated into the fiber bundles. In another embodiment, the fiber bundles can be held between two resin sheets respectively obtained by thinly and uniformly applying a resin to such a sheet as paper or resin film treated to be releasable, and the laminate is pressurized using hot nips etc. Other hot nips, nips, heating/cooling plates, rakes, rollers, etc. can be present throughout the composite processing machine.

In certain embodiments of the method for producing a continuous rolled prepreg, a fiber bundle spacing means such as a rake or comb will be positioned between the tension creel and the fiber spreading apparatus and between the fiber spreading apparatus and the composite processing machine in order to maintain uniformity between the fiber bundles. In certain embodiments, the method will include multiple spacing means such as when there are multiple sets of a plurality of adjacent fiber bundles. In these instances the spacing means proximate to the composite processing system can be slightly off-set with one another in order to ensure that as the fiber bundles exit the spreader device and enter the composite processing system the fiber bundles overlap slightly with each other before they are compacted by the nip rollers in order to further reduce gaps between fibers and promote fiber-resin distribution. The spacing means can be substantially the width corresponding to that of the prepreg sheet.

In a further aspect, the invention also provides articles of manufacture composed of a prepreg made according to the invention described herein in detail. The articles can include any composite article made from preimpregnated fibers or fiber sheets such as aerospace or high performance industrial, automotive, or leisure materials.

In a final aspect, the invention also provides a composite processing system having two or more fiber spreading devices according to the invention described herein, wherein each device is situated in a different path and able to receive a set of a plurality of adjacent fiber bundles.

Other embodiments of the invention include, but are not limited to, the following:

1. An apparatus for producing a spread fiber bundle comprising:
   a tension control module comprising:
   i) a tension building unit configured as a series of static bars; and
   ii) a tension reducing unit configured as a series of driven rollers, wherein the static bars and driven rollers are positioned perpendicular to the direction of a running fiber bundle that makes direct wrapping contact with the surface of said static bars and driven rollers, and wherein the peripheral surface speed of the driven rollers is at least three times the speed of the running fiber bundle.

2. An apparatus according to embodiment 1, wherein the running fiber bundle is chosen from carbon, glass, polyamide, polyamide-imide, polyimide, aramid, and combinations thereof.
3. An apparatus according to embodiments 1 or 2, wherein the running fiber bundle comprises multiple adjacent bundles.
4. An apparatus according to any of the preceding embodiments further comprising a second tension control module in a different path than the first apparatus, wherein a second running fiber bundle comprising a plurality of multiple adjacent fiber bundles makes direct wrapping contact with the surface of the static bars and driven rollers of said second apparatus.
5. An apparatus according to any of the preceding embodiments, wherein the final spread width of the running fiber bundle is up to 3.5 times the original width of the fiber bundle.
6. An apparatus according to any of the preceding embodiments, wherein the tension building unit is alternatively provided by a member chosen from: a tension creel; one or more low speed driven rollers operating at a slower speed than the speed of the running fiber bundle; and combinations of low speed driven rollers and static bars.
7. An apparatus according to any of the preceding embodiments further comprising a tension mediating unit comprising a series of driven rollers and static bars.
8. An apparatus according to any of the preceding embodiments, wherein the tension reducing unit is provided by a series of driven rollers.
9. An apparatus according to any one of the preceding embodiments, wherein the peripheral surface speed of the driven rollers ranges from 3 to 100 times the speed of the running fiber bundle.
10. An apparatus according to any one of the preceding embodiments, wherein the peripheral surface speed of the driven rollers ranges from 3 to 50 times the speed of the running fiber bundle.
11. An apparatus according to any one of the preceding embodiments, wherein the peripheral surface speed of the driven rollers ranges from 3 to 25 times the speed of the running fiber bundle.
12. An apparatus according to any one of the preceding embodiments, wherein the peripheral surface speed of the driven rollers ranges from 3 to 10 times the speed of the running fiber bundle.
13. An apparatus according to any of the preceding embodiments wherein the static bars and/or driven rollers contain a surface morphology.
14. An apparatus according to embodiment 13, wherein the surface morphology is axial to the direction of the driven roller and static bar.
15. An apparatus according to any of the preceding embodiments further comprising at least one rake.
16. An apparatus according to embodiment 15, wherein the rake is situated upstream from the tension building unit.
17. An apparatus according to embodiments 15 or 16, wherein the rake is situated between the tension building unit and the tension reducing unit.
18. An apparatus according to any of the preceding embodiments further comprising at least one heating source positioned to heat the running fiber.
19. An apparatus according to any of the preceding embodiments, wherein the apparatus is a component of a composite processing machine and is situated downstream from a creel and upstream from an impregnation system.
20. An apparatus according to any of the preceding embodiments, wherein the apparatus is a component of a weaver loom and is situated downstream from a creel and upstream from an composite processing machine.
21. A method for producing a spread fiber bundle using an apparatus according to any one of embodiments 1-20 comprising:
    a) running a fiber bundle in direct wrapping contact with the surface of a series of static bars and driven rollers; and
    b) controlling tension of the fiber through the apparatus by operating the driven rollers at a higher differential speed in relation to the speed of the running fiber bundle, thereby spreading the fiber bundle.

22. A method according to embodiment 21 further comprising at any step heating at least one static bar and/or driven roller or heating the fiber bundle per se.
23. A method according to any one of embodiments 21-22 further comprising at any step uniformly spacing multiple adjacent fiber bundles with a rake.
24. A method according to any one of embodiments 21-23 further comprising applying a surface morphology to one or more rollers in the series.
25. A method according to any one of embodiments 21-23 further comprising taking-up the spread fiber with a take-up drum.
26. A method for the continuous production of rolled pre-preg unidirectionally arranged in parallel and having uniform distribution between fibers, the method comprising:

a) integrating an apparatus according to any one of embodiments 1-20 as part of a composite processing machine;

b) running a set of a plurality of adjacent fiber bundles in direct wrapping contact with the surface of a series of static bars and driven rollers of the apparatus;

c) spreading the plurality of adjacent fiber bundles by operating the driven rollers at a higher differential speed in relation to the speed of the running fiber bundle; and d) impregnating the spread fiber bundles with a pre-determined amount of resin.

27. A method according to embodiment 29, wherein step (a) further comprises integrating a second apparatus according to any one of embodiments 1-20 to the composite processing machine in a different path than the first apparatus, and wherein step (b) further comprises running a second set of a plurality of adjacent fiber bundles in direct wrapping contact with the surface of a series of static bars and driven rollers of the second apparatus.
28. A method according to any one of embodiments 26-27 further comprising uniformly spacing the plurality of adjacent fiber bundles prior to contact with the fiber spreader apparatus with a spacing means.
29. A method according to any one of embodiments 26-28 further comprising uniformly spacing the plurality of adjacent fiber bundles prior to the impregnating step with a spacing means.
30. A method according to embodiment 29, wherein the spacing means are offset from one another when there are multiple sets of fiber bundles.
31. A method according to any one of embodiments 26-30, wherein the resin is a thermoplastic or thermoset resin.
32. A method according to any one of embodiments 26-31, wherein the resin is applied to both the top and bottom of the spread fibers, or immersed in a solution or slurry tank.
33. A method according to any one of embodiments 26-32, wherein the impregnating step is performed by a series of one or more hot nips, hot plates, and cooling plates, or by a solution or slurry tank.
34. A method for producing a pre-preg unidirectionally arranged in parallel, the method comprising impregnating a pre-determined amount of resin into a spread fiber bundle produced according to any one of embodiments 21-25.
35. A pre-preg unidirectionally arranged in parallel made according to the method of any one of embodiments 26-34.
36. An article of manufacture comprising a prepreg according to embodiment 35.
37. A composite processing system comprising two or more fiber spreading apparatuses according to any one of embodiments 1-20, wherein each apparatus is situated in a different path and able to receive a set of a plurality of adjacent fiber bundles.

EXAMPLES

The following examples are provided to assist one skilled in the art to further understand certain embodiments of the present invention. These examples are intended for illustration purposes and are not to be construed as limiting the scope of the various embodiments of the present invention.

Example 1

Production of a Prepreg Sheet Having Low Fiber Areal Weight (FAW) of 70 Grams Per Square Meter (gsm)

Referring to FIG. 3, where corresponding elements are assigned common identifiers, and which depicts two fiber spreading devices according to the invention as integrated components in a composite processing system for carrying out the continuous prepreg producing method according to the invention, it is shown that two sets of a plurality of adjacent fiber bundles 31 (such as T650-35, a 12K filament/bundle fiber supplied by Cytec Carbon Fibers (South Carolina) and having a standard spread modulus of 145 gsm) are running in a 2-pattern spread at a line speed of approximately 2-5 m/min. (i.e., 2 m/min., 3 m/min., 4 m/min., or 5 m/min. as determined by the speed of a pull roll (not shown) of the composite processing system) as they are unwound from bobbins set on a tension creel (not shown), set uniformly by a low wrap angle static bar 32, and are metered with a comb 33. The tow tension of the fiber bundles 31 is increased as the plurality of adjacent fiber bundles make direct wrapping contact with a series of static bars provided by the tension building unit 34*a* of the fiber spreading apparatus according to the invention 34, and which contain a surface morphology applied by 180 grit sandpaper in the axial direction. The sizing on the fiber bundles is preheated with a radiant heater 35*a* positioned near the tension building unit 34*a*. The tow tension of the running fiber bundles is managed as they make direct wrapping contact with a series of driven rollers provided by a tension mediating unit 34*b* of the fiber spreading apparatus according to the invention 34, and which contain a surface morphology applied by 180 grit sandpaper in the axial direction. The driven rollers are rotated in the direction of the running fiber bundle at various speeds ranging from 0.5 to 11 times than line speed (i.e., the speed of the running fiber bundles) to increase and then reduce tension levels just below the fiber limitations. The web of tows is then heated again with a radiant heater 35*b* before finally reducing tension of the fiber bundles by placing them in direct wrapping contact with a series of high speed driven rollers provided by a tension reducing unit 34*c* of the fiber spreading apparatus according to the invention 34, and which contain a surface morphology applied by 180 grit sandpaper in the axial direction. The tension reducing unit 34*c* is located within close proximity to a nip roller 38 carrying a resin film 39 which film is placed on the spread fiber, which is then (resin film on spread fiber together) pulled in between the nip rollers 38 and compacted at 35 grams per square meter per set of fiber bundles.

Thus, this process is performed simultaneously with the upper and lower set of the plurality of adjacent fiber bundles (from either the same or separate creel), each being compacted at 35 gsm. The results yield a highly impregnated, uniformly spread 70 gsm tape 40 with no gaps or fuzz from a fiber that ordinarily is only able to achieve a FAW of 145 gsm (i.e., 72.5 gsm per set of multiply adjacent bundles). Temperature and fiber tensions are important as either too high a temperature (e.g., above 130° F.) or tension (e.g., above 4000 gram-force per tow) will cause the tows of this product to start to fray and on the high speed driven rolls to start to wrap. Accordingly, lower tensions and lower heater temperatures should be ensured for this type of fiber.

Example 2

Production of a Prepreg Sheet Having Low Fiber Areal Weight (FAW) of 145 Grams Per Square Meter (gsm)

A prepreg sheet with a standard fiber areal weight (FAW) of 145 grams per square meter (gsm) using an intermediate modulus fiber (such as IM-7G', a 12K filament/bundle fiber supplied by Hexcel Corp. (Stamford, Conn.)) is made as in Example 1. However, only two static bars are used in the tension building section 34*a* and only two driven rollers are used in each of the tension managing section 34*b* (low speed driven rollers and/or high speed driven rollers) and tension reducing section 34*c* (high speed driven rollers) of the fiber spreading device according to the invention 34. Heaters 35*a* and 35*b* are not used. The tow web (or fiber bundles) is spread to a FAW of 72.5 gsm for each of the upper and lower sets of multiply adjacent fiber bundles, and then combined at the nip 38 to make a highly impregnated, uniformly spread prepreg sheet having a FAW of 145 gsm without gaps or fuzz.

Various patent and/or scientific literature references have been referred to throughout this application. The disclosures of these publications in their entireties are hereby incorporated by reference as if written herein. In view of the above description and the examples, one of ordinary skill in the art will be able to practice the disclosure as claimed without undue experimentation.

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion, but should be defined by the appended claims.

The invention claimed is:

1. An apparatus for producing a spread fiber bundle comprising:

a tension control module comprising:

i) a tension building unit comprising a series of static bars configured to increase tension in a running fiber bundle moving in a traveling direction; and ii) a tension reducing unit comprising a series of driven rollers configured to reduce tension in the running fiber bundle, each driven roller being independently rotatable, wherein the tension reducing unit is positioned downstream from the tension building unit along the traveling direction of the running fiber bundle such that, during operation, the running fiber bundle makes direct wrapping contact with the surface of said static bars prior to making direct wrapping contact with said driven rollers, and wherein the peripheral surface speed of the driven rollers is at least three times the speed of the running fiber bundle.

2. An apparatus according to claim 1 further comprising a spool of fiber for supplying the running fiber bundle, wherein the spool of fiber is positioned upstream from the tension building unit along the traveling direction of the running fiber bundle.

3. An apparatus according to claim 1 further comprising a second tension control module in a different path than that of said tension control module, said second tension control module comprising a second tension building unit comprising a series of static bars, and a second tension reducing unit comprising a series of driven rollers, each driven roller of the second tension reducing unit being independently rotatable about its own axis, wherein the second tension reducing unit is positioned downstream from the second tension building unit along a traveling direction of a second running fiber bundle such that, during operation, the second fiber bundle makes direct wrapping contact with the surface of the static bars of said second tension building unit prior to making wrapping contact with the surface of the driven rollers of said second tension reducing unit.

4. An apparatus according to claim 2, wherein the final spread width of the running fiber bundle exiting the tension reducing unit is up to 3.5 times the original width of the fiber bundle.

5. An apparatus according to claim 1, wherein the tension building unit further comprising one or more low speed driven rollers operating at a slower speed than the speed of the running fiber bundle.

6. An apparatus according to claim 1 further comprising a tension moderating section comprising a series of alternating driven rollers and static bars positioned between the tension building unit and the tension reducing unit along the traveling direction of the running fiber bundle.

7. An apparatus according to claim 1 further comprising a separate drive motor for independently rotating each of the driven rollers such that the peripheral surface speed of the driven rollers ranges from 3 to 100 times the speed of the running fiber bundle.

8. An apparatus according to claim 1, wherein the static bars or the driven rollers contain a sanded surface finish.

9. An apparatus according to claim 1 further comprising at least one rake.

10. An apparatus according to claim 9, wherein the rake is situated upstream from the tension building unit.

11. An apparatus according to claim 9, wherein the rake is situated between the tension building unit and the tension reducing unit.

12. An apparatus according to claim 1 further comprising at least one heating source positioned to heat the running fiber bundle.

13. A composite processing machine comprising the apparatus according to claim 1 positioned downstream from a creel for supplying a running fiber bundle and upstream from an impregnation system.

14. A method for producing a spread fiber bundle comprising:

a) running a fiber bundle through the apparatus of claim 1 such that the fiber bundle makes direct wrapping contact with the surface of the series of static bars prior to making direct wrapping contact with the series of driven rollers; and b) controlling tension of the fiber bundle through the apparatus by operating the driven rollers at a peripheral surface speed that is at least three times the speed of the running fiber bundle, thereby spreading the fiber bundle.

15. A method according to claim 14 further comprising heating at least one of the following: the static bars, the driven rollers, and the fiber bundle.

16. A method according to claim 14 further comprising taking-up the spread fiber with a take-up drum.

* * * * *